US008575044B2

(12) United States Patent
Johnson et al.

(10) Patent No.: US 8,575,044 B2
(45) Date of Patent: Nov. 5, 2013

(54) PACKABLE WATER RESISTANT INSULATED ARTICLES

(75) Inventors: Matthew A. Johnson, Wilmington, DE (US); Steven G. Mayer, Landenberg, PA (US)

(73) Assignee: W. L. Gore & Associates, Inc., Newark, DE (US)

( * ) Notice: Subject to any disclaimer, the term of this patent is extended or adjusted under 35 U.S.C. 154(b) by 784 days.

(21) Appl. No.: 11/627,217

(22) Filed: Jan. 25, 2007

(65) Prior Publication Data

US 2008/0182096 A1 Jul. 31, 2008

(51) Int. Cl.
*A41D 1/00* (2006.01)
*A41D 13/00* (2006.01)

(52) U.S. Cl.
USPC ..... 442/85; 442/76; 442/79; 442/86; 2/69; 2/69.5; 2/87; 5/413 R

(58) Field of Classification Search
USPC ..... 5/413 R; 2/93, 97, 108, 69, 69.5, 87; 442/30, 221, 238, 239, 246, 315, 76, 442/79, 85, 86, 46; 428/219
See application file for complete search history.

(56) References Cited

U.S. PATENT DOCUMENTS

| | | | | |
|---|---|---|---|---|
| 3,953,566 | A | 4/1976 | Gore | |
| 4,194,041 | A | 3/1980 | Gore et al. | |
| 4,545,841 | A | 10/1985 | Jackrel | |
| 4,868,928 | A | 9/1989 | Norvell | |
| 4,992,327 | A * | 2/1991 | Donovan et al. | 428/198 |
| 5,454,471 | A | 10/1995 | Norvell | |
| 5,472,760 | A | 12/1995 | Norvell | |
| 5,565,254 | A | 10/1996 | Norvell | |
| 5,811,167 | A | 9/1998 | Norvell | |
| 7,111,328 | B2 | 9/2006 | Bay | |
| 2004/0040087 | A1 | 3/2004 | Lack et al. | |
| 2005/0124256 | A1 | 6/2005 | Mason et al. | |
| 2005/0136762 | A1 * | 6/2005 | Norvell et al. | 442/85 |
| 2006/0195964 | A1 | 9/2006 | Burty | |

FOREIGN PATENT DOCUMENTS

| | | |
|---|---|---|
| JP | 02-014078 | 1/1990 |
| WO | WO2005/040762 | 5/2005 |

OTHER PUBLICATIONS

Anonymous: "GTX Outerwear", Internet Article, Dec. 7, 2006, URL: http://web.archive.org/web/20061207091414/http://www.blauer.com/bl_blauer_better_details.

Anonymous: "Himountain 2007/2008", Internet Article, Mar. 2006, XP002483285, URL: http://www.himountain.eu/Hi-kat-2007-ang.pdf.

Anonymous: "Ar'teryx—The Radical Alpine Winter-Hardshel", Internet Article, 2003, XP002483286, URL: http://www.sportsgearquide.com/magazine-article.

Anonymous: "Drunter and Drueber", Outdoor, 2003, XP002483287 p. 12 & Petra KnechtZ: "Funktionstextilien" 2003, Deutscher Fachverlag, Frankfurt, XP002483292, pp. 287 and pp. 298, 299.

Anonymous: "Sleep Well" Ajungilak / Mammut, Nov. 2003, XP002483288, p. 8.

(Continued)

*Primary Examiner* — Matthew Matzek
(74) *Attorney, Agent, or Firm* — Amy L. Miller

(57) ABSTRACT

Breathable, water resistant protective articles, such as garments, sleeping bags, and the like, which are readily packable into small volumes. The articles are constructed from an outer layer comprising a laminate of a textile bonded to a barrier layer, an insulation layer and an inner layer comprising an air permeable textile.

30 Claims, 2 Drawing Sheets

(56) References Cited

OTHER PUBLICATIONS

Anonymous: "Genuine U.S. Military Issue Sleeping Bags", Internet Article, Dec. 17, 2006, XP002483289, URL: http://web.archive.orq/web/20061217212751 ; http://.www.imsplus.com/ims61b.html, p. 1.

Anonymous: "Katalog 2003/2004", Mountain Equipment, 2003, XP002483290, pp. 5, 8, 9 and pp. 20, 21.

Anonymous: Kalalog 2003, Mammut, 2003, XP002483291, pp. 83, 86, 87 and p. 98.

* cited by examiner

PACKABLE WATER RESISTANT INSULATED ARTICLES

FIELD OF THE INVENTION

The present invention relates to insulated protective articles, such as garments and sleeping bags, which are breathable, water resistant and readily packable.

BACKGROUND OF THE INVENTION

There is a need for breathable, water resistant, insulated gear which is readily packable into backpacks, duffel bags or other transport containers for those individuals who desire lightweight, transportable protection from the elements.

Conventional waterproof or water resistant, breathable insulated articles suffer from problems such as high bulk and lengthy time to remove air from the articles when trying to roll, fold or otherwise minimize the size of the articles to fit into a pack or other transport means. For example, conventional waterproof, breathable insulated garments and sleeping bags require a relatively significant time to force air out of the insulated article prior to packing, and even then, the amount of air remaining in the article increases the packing volume, thus reducing the space available for additional articles.

Accordingly, a need has existed for insulated protective articles which are breathable, water resistant and readily packable.

SUMMARY OF THE INVENTION

The present invention is directed to breathable, water resistant protective articles, such as garments, sleeping bags, and the like, which can be easily packed into small volumes in a short amount of time. The articles are constructed from an outer layer comprising a laminate of a textile bonded to a barrier layer, an insulation layer and an inner layer comprising an air permeable textile.

In one embodiment, an article of the present invention is constructed from an outer layer comprising a laminate of a textile bonded to a barrier layer, the laminate having a water leakage of about 1 g/$H_2O$ or less, a breathability of about 1000 g/$m^2$/24 h or greater and an air permeability of about 0.3 cfm or greater; an insulation layer; and an inner layer comprising an air permeable textile. In an alternate embodiment, the outer layer of the article may have an air permeability of about 0.8 cfm or greater. In a further alternative, the outer layer of the article may have an air permeability of about 4 cfm or greater.

As noted above, the inner layer of the article comprises an air permeable textile. Depending on the desired features of the finished article, the inner layer may, in one embodiment, be selected to have an air permeability greater than the air permeability of the outer layer.

Overall weight of the construction of the present invention can vary widely depending on the desired performance characteristics of the articles. The material weight per unit area of the articles of this invention depends, among other factors, on the selection of the component materials used. Preferably, the articles of this invention have a material weight of less than 40 oz/yd2. Articles of the invention can also be made having a weight per unit area less than 30 oz/yd2, and even less than 15 oz/yd2. In instances where weight is a significant factor in use and desirable constructions are those with lower weights, the overall weight of the article may be tailored to be on the order of 10 oz/$yd^2$ or less, or as low as 8 oz/$yd^2$ or less, or even as low as 6 oz/$yd^2$ or less.

In some instances, it may be desirable that the article be sufficiently durable to withstand multiple uses. Accordingly, in one embodiment of the invention, articles of the present invention have a durable water leakage, as determined after 40 hours of washing, described in more detail herein, of about 1 g$H_2O$ or less.

Suitable textile structures which may be used for the textile components of the present invention can include, for example, wovens, nonwovens, knits, etc., and the compositions can vary widely depending on the desired properties of the end article. Materials such as nylons, polyesters, polyurethanes, cottons, and other natural and synthetic materials are within the scope of contemplated textile materials the present invention.

The barrier material of the laminate may be a protective membrane or film. It may be selected from the group of materials including, but not limited to, polyesters, polyamides, polyketones, polysulphones, polycarbonates, fluoropolymers, polyacrylates, co-polyether esters, co-polyether amides, polyurethanes, polyvinylchloride, polytetrafluoroethylene or polyolefins. Expanded polytetrafluoroethylene (ePTFE) is one example of a suitable barrier layer. The ePTFE may be provided with a coating of a hydrophilic or hydrophobic polymer in known manner.

Suitable insulation layers which may be used in the present invention include any synthetic fiber thermal insulating material, typically in the form of a cohesive fiber structure, such as a non-woven batting, or the like. One commercially available example of a suitable insulation layer is a non-woven construction made from ultra-fine microfibers and sold under the tradename PRIMALOFT®. Other comparable materials which provide insulation within an article are also contemplated to be within the scope of the present invention.

A unique aspect of the novel articles of the present invention is that the unique construction described provides for enhanced packability. Particularly, due to the nature of the materials, articles can be quickly and readily packed into a small volume. The packing volume of articles of the present invention is surprisingly small compared to prior art insulated articles. Packing volume can be tailored depending on the component materials of the articles of the present invention. For example, in certain embodiments, garments have a packing volume on the order of less than about 1000 $in^3$, even less than about 800 $in^3$, even less than about 500 $in^3$, and even as low as of 300 $in^3$ or less can be constructed. Moreover, in certain embodiments, sleeping bags of the present invention having packing volumes on the order of less than about 1000 $in^3$, even less than about 800 $in^3$, even less than about 600 $in^3$, and even as low as about 500 $in^3$ or less can be constructed.

DESCRIPTION OF THE DRAWINGS

The foregoing summary, as well as the following detailed description of the invention, will be better understood when read in conjunction with the appended drawings. For purposes of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
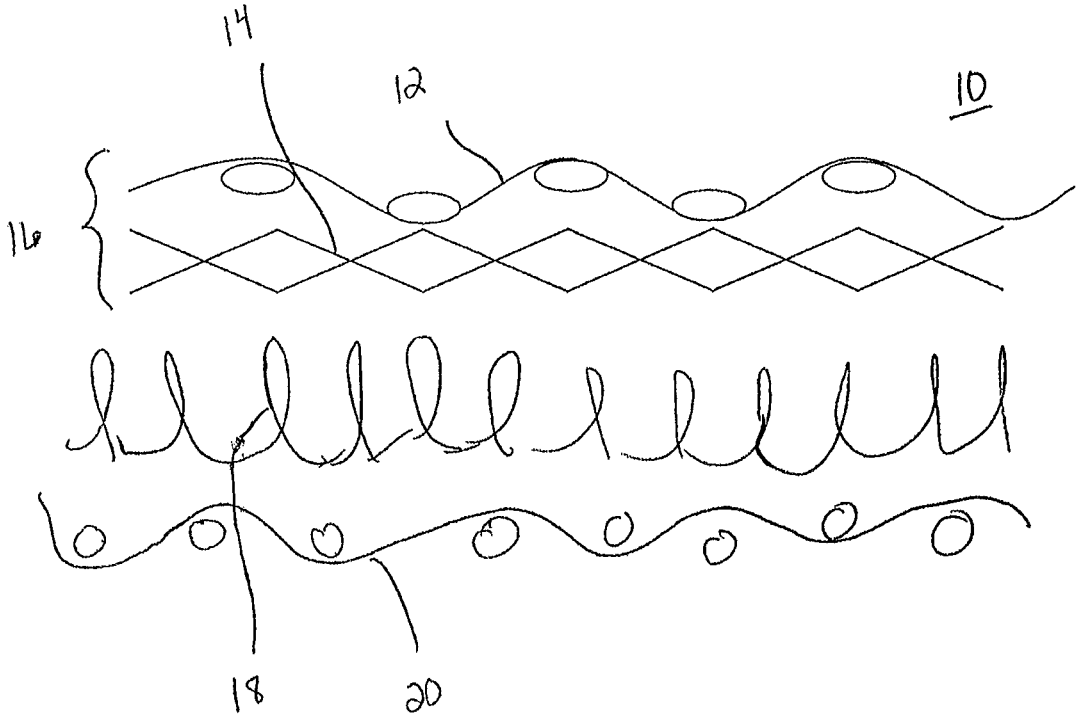
FIG. 1 is a cross-sectional view of one embodiment of an article of the present invention.

Referring to FIG. 1, there is shown a first embodiment of the construction of the present invention. Specifically, the layered construction of the article 10 comprises an outer textile 12 laminated to a barrier layer 14 to form an outer layer 16 of the article 10. An insulation layer 18 is oriented adjacent the barrier layer 14 of the outer layer 16, and an inner textile layer 20 is oriented adjacent the insulation layer 18.

Figure 2:
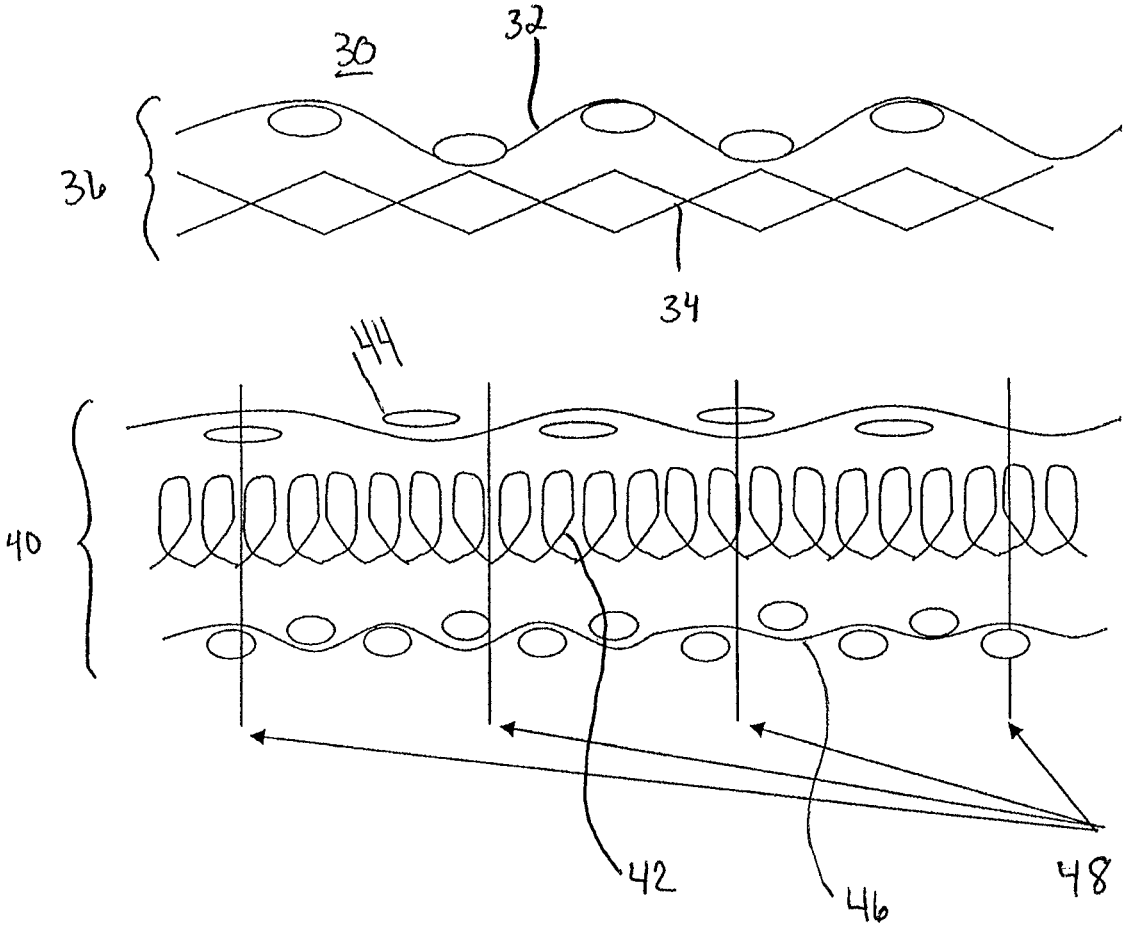
FIG. 2 is a cross-sectional view of an alternate embodiment of an article of the present invention.

In an alternative embodiment of a suitable construction of the present invention, shown in FIG. 2, the layered construction of the article 30 comprises an outer textile 32 laminated to a barrier layer 34 to form an outer layer 36 of the article 30. An insulation package 40 is oriented adjacent the outer layer 36 of the article. The insulation package 40 comprises an insulation layer 42, oriented between an inner textile layer 46 and an optional additional textile layer 44. It should be noted than an alternate construction of the insulation package without the additional textile layer is within the scope of contemplated constructions of the invention. Optional quilting stitches 48 can be used and may assist in stabilizing the insulation layer during assembly and use of the article.

MEASUREMENT AND TEST METHODS

Moisture Vapor Transmission Rate

The material was tested following the procedure defined in ASTM E-96, Procedure B, "Standard Test Method for Water Vapor Transmission of Materials".

Water Resistance/Hydrostatic Resistance

The material was tested following the procedure defined in FED-STD-191A Method 55164. Performance of a material is reported in terms of a water leakage of a measured amount.

Durable Water Resistance/Hydrostatic Resistance

Material is tested as described above for Water Resistance, except that the test is performed after 40 hours of washing the material using the following regimen: The samples were put in a washing machine and washed continuously for 40 hours.

Air Permeability

The material was tested following the procedure defined in ASTM D737-04, "Standard Test Method for Air Permeability of Textile Fabrics"

Packing Volume

A test rig was used comprising a ½"-thick LEXAN® cylinder measuring 5.5" in diameter with an open top and a plunger that sits squarely upright in the cylinder and is not airtight with the walls of the cylinder. The plunger is removed from the cylinder, the test sample is inserted in the cylinder, and the plunger is placed in the cylinder on top of the sample. Weights are slowly added until a 48 lbf load is reached. The weights are oriented so as to not touch the sides of the cylinder. If any of the weights are released rapidly, the test is nullified. Once the desired weight has been applied, a measurement is taken from the base of the cylinder to the bottom of the plunger in order to obtain the mean compressed height. The sample is then removed from the cylinder and fluffed prior to repeating the test. The test is repeated five (5) times and the data shall be averaged. The volume of the compressed material is calculated by multiplying the area of the plunger (23.76 square inches) by the mean compressed height. Packing volume is reported in cubic inches ($in^3$).

Water Entry Pressure

Water entry pressure was determined using "Option 2-Hydrostatic Head Tester" of the standard test method AATCC 127-2003 entitled "Water Resistance: Hydrostatic Pressure Test".

Without intending to limit the scope of the present invention, the following examples illustrate how the present invention may be made and used:

EXAMPLES

Example 1

A garment of the present invention was constructed, wherein the garment had an outer layer comprising a laminate of a textile and a barrier layer, an insulation layer, and an inner layer comprising an air permeable textile.

The laminate of this example was constructed using a nylon woven textile, (style number 131907, Milliken & Company, Spartanburg, S.C.) and a barrier layer of expanded PTFE made according to the teachings of U.S. Pat. No. 3,953,566. Particularly, the nylon woven textile layer was adhered to one side of the expanded PTFE layer by gravure printing a discrete dot pattern of a moisture curing polyurethane adhesive onto the membrane and subsequently nipping the nylon woven textile to the ePTFE membrane generally in accordance with the teachings of U.S. Pat. No. 4,194,041. Subsequent to lamination, the woven nylon side of the laminate was coated with a fluoroacrylate based water repellent treatment. Properties of this laminate construction are shown in Table 1.

An insulation layer was obtained comprising a 6 oz/$yd^2$ multi-diameter, polyester, staple fiber (PRIMALOFT® Sport, PRIMALOFT®, Albany, N.Y.). The insulation layer was cut to the desired size and pattern prior to construction of the garment.

The inner textile layer comprised a durably water repellant coated 1.9 oz/$yd^2$, calendared, 100% nylon, rip-stop woven textile.

The insulation layer and inner textile layer were quilted together to prevent migration of the polyester fibers of the insulation layer. Conventional quilting methods were used such that the insulation layer was located between, a scrim and the inner textile layer. The outer layer described above and the quilted insulation/inner textile layer were subsequently connected and assembled using conventional cut and sew garment construction techniques. Properties of the finished garment are reported in Table 2.

Example 2

A sleeping bag of the present invention was constructed, wherein the sleeping bag had an outer layer comprising a laminate of a textile and a barrier material, an insulation layer, and an inner layer comprising an air permeable textile. The sleeping bag of this example was made using the same material layers as described in Example 1, except the two-layer laminate comprised a directionally more open barrier layer had a heavier coating of the fluoroacrylate based water repellent treatment. Properties for the outer layer comprising the two-layer laminate are shown in Table 1. The combined weight per unit area of the materials of this embodiment was approximately 10 oz/$yd^2$.

Conventional cut and sew sleeping bag construction techniques were used to assemble the sleeping bag. Properties of the finished sleeping bag are shown in Table 2.

Example 3

Another article of the present invention was constructed in a manner similar to that described in Example 2, except that the insulation layer used was a 6 oz/$yd^2$ polyester continuous filament (CLIMASHIELD® XP, CLIMASHIELD®, Clinton, Tenn.). The resulting construction was soft, water resistant and air permeable, confirming that various forms of insulation may be used.

Example 4

Another article of the present invention was constructed in a manner similar to Example 1, except that the nylon woven textile used to construct the two-layer laminate was replaced with a polyester knit textile (style number 758616, Milliken & Company, Spartanburg, S.C.), and a more open expanded PTFE membrane was used. The outer layer laminate properties are shown in Table 1.

TABLE 1

Outer Layer Laminate Properties

| Example | Moisture Vapor Transmission Rate ($g/m^2/24$ h) | Water Resistance/ Hydrostatic Resistance (initial)\(g $H_2O$) | Durable Water Resistance/ Hydrostatic Resistance (after 40 hrs of wash) (g $H_2O$) | Air Permeability (cfm) | Hydrostatic Pressure WEP (psi) |
|---|---|---|---|---|---|
| 1 | 1084 | 0 | n/a | 0.50 | >14.2 |
| 2 | 1084 | 0 | 0 | 0.76 | >14.2 |
| 4 | n/a | 0 | n/a | 4.6 | 4.1 |

TABLE 2

Assembled Article Properties

| Example | Hydrostatic Resistance (initial) (g $H_2O$) | Air Permeability (cfm) | Packing Volume ($in^3$) |
|---|---|---|---|
| 1 | 0 | 0.41 | 294 |
| 2 | 0 | 0.46 | 462 |

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. An article comprising:

(a) an outer layer comprising a laminate of a textile bonded to a barrier material, said laminate having a water leakage of about 1 g/$H_2O$ or less after 40 hours of washing, a breathability of about 1000 $g/m^2/24$ h or greater and an air permeability of about 0.3 cfm or greater;

(b) an insulation layer comprising a synthetic fiber insulating material; and (c) an inner layer comprising an air permeable textile, wherein said article has a packing volume of 600 $in^3$ or less.

2. The article of claim 1, wherein said outer layer has an air permeability of about 0.8 cfm or greater.

3. The article of claim 1, wherein said outer layer has an air permeability of about 4 cfm or greater.

4. The article of claim 1, wherein said inner layer has an air permeability greater than the air permeability of the outer layer.

5. The article of claim 1 in the form of a garment.

6. The article of claim 1 in the form of a sleeping bag.

7. The article of claim 1, wherein said article has a durable water leakage of less than about 1 g/$H_2O$ after 40 hours of washing.

8. An article comprising:

(a) an outer layer comprising a laminate of a textile bonded to a barrier material, said laminate having a water leakage of about 1 g/$H_2O$ or less after 40 hours of washing, a breathability of about 1000 $g/m^2/24$ h or greater and an air permeability of about 0.3 cfm or greater; and (b) an insulation package layer comprising an insulation layer comprising a synthetic fiber insulating material oriented between two air permeable textile layers, said insulation package being quilted together, wherein said article has a packing volume of 600 $in^3$ or less.

9. The article of claim 8, wherein said outer layer has an air permeability of about 0.8 cfm or greater.

10. The article of claim 8, wherein said outer layer has an air permeability of about 4 cfm or greater.

11. The article of claim 8, wherein each of said textile layers of said insulation package has an air permeability greater than the air permeability of the outer layer.

12. The article of claim 8 in the form of a garment.

13. The article of claim 8 in the form of a sleeping bag.

14. The article of claim 8, wherein said article has a durable water leakage of less than about 1 g/$H_2O$ after 40 hours of washing.

15. The article of claim 1, wherein said article is in the form of a sleeping bag has and has a packing volume of 500 $in^3$ or less.

16. The article of claim 1, wherein said article is in the form of a garment and has a packing volume of 300 $in^3$ or less.

17. An article comprising:

(a) an outer layer comprising a laminate of a textile bonded to a barrier material, said laminate having a water leakage of about 1 g/$H_2O$ or less after 40 hours of washing, a breathability of about 1000 $g/m^2/24$ h or greater and an air permeability of about 0.3 cfm or greater;

(b) an insulation layer comprising a synthetic fiber insulating material oriented adjacent said barrier material; and (c) an inner layer comprising an air permeable textile, wherein said article has a packing volume of 600 $in^3$ or less.

18. The article of claim 17, wherein said outer layer has an air permeability of about 0.8 cfm or greater.

19. The article of claim 17, wherein said outer layer has an air permeability of about 4 cfm or greater.

20. The article of claim 17, wherein said inner layer has an air permeability greater than the air permeability of the outer layer.

21. The article of claim 17 in the form of a garment.

22. The article of claim 17 in the form of a sleeping bag.

23. The article of claim 17, wherein said article has a durable water leakage of less than about 1 g/$H_2O$ after 40 hours of washing.

24. An article comprising:

(a) an outer layer comprising a laminate of a textile bonded to a barrier material, said laminate having a water leakage of about 1 g $H_2O$ or less after 40 hours of washing, a breathability of about 1000 $g/m^2/24$ h or greater, and an air permeability of about 0.3 cfm or greater; and (b) an insulation package layer comprising an insulation layer comprising a synthetic fiber insulating material oriented adjacent an inner air permeable textile layer, said insulation package being quilted together, wherein said article has a packing volume of 600 $in^3$ or less.

25. The article of claim 24, wherein said outer layer has an air permeability of about 0.8 cfm or greater.

26. The article of claim 24, wherein said outer layer has an air permeability of about 4 cfm or greater.

27. The article of claim 24, wherein each of said textile layers of said insulation package has an air permeability greater than the air permeability of the outer layer.

28. The article of claim 24 in the form of a garment.

29. The article of claim 24 in the form of a sleeping bag.

30. The article of claim 24, wherein said article has a durable water leakage of less than about 1 g/$H_2O$.

* * * * *